US012540800B2

(12) United States Patent
Fowler

(10) Patent No.: US 12,540,800 B2
(45) Date of Patent: Feb. 3, 2026

(54) SYSTEMS AND METHODS FOR PROVIDING A DEPLOYABLE PERIMETER SECURITY APPARATUS

(71) Applicant: GOLDENEYE DEFENSE LLC, Newnan, GA (US)

(72) Inventor: Clayton Erik Fowler, Newnan, GA (US)

(73) Assignee: GOLDENEYE DEFENSE LLC, Newnan, GA (US)

( * ) Notice: Subject to any disclaimer, the term of this patent is extended or adjusted under 35 U.S.C. 154(b) by 0 days.

(21) Appl. No.: 18/970,637

(22) Filed: Dec. 5, 2024

(65) Prior Publication Data

US 2025/0180336 A1 Jun. 5, 2025

Related U.S. Application Data

(60) Provisional application No. 63/606,496, filed on Dec. 5, 2023.

(51) Int. Cl.
*F41H 5/24* (2006.01)

(52) U.S. Cl.
CPC ..... *F41H 5/24* (2013.01)

(58) Field of Classification Search
CPC ..... F41H 5/06; F41H 5/24
See application file for complete search history.

(56) References Cited

U.S. PATENT DOCUMENTS

| | | | | |
|---|---|---|---|---|
| 11,280,588 | B1 * | 3/2022 | Esquilin-Mangual | F41H 5/24 |
| 2020/0393216 | A1 * | 12/2020 | Maji | F41H 5/02 |
| 2023/0392904 | A1 * | 12/2023 | Gozzola, Sr. | B65D 90/0073 |
| 2025/0003718 | A1 * | 1/2025 | Giordano | F41H 5/24 |

* cited by examiner

*Primary Examiner* — J. Woodrow Eldred
(74) *Attorney, Agent, or Firm* — CHRISTOPHER J CHAN IP LAW LLC

(57) ABSTRACT

Embodiments of the disclosure can provide systems and methods for providing a deployable perimeter security apparatus. The apparatus can include a frame with a box-shape, including a first opposing side and a second opposing side; an anchor device operable to extend from a third side of the frame; a first intermediate panel operable to telescope from the first opposing side of the frame; a second intermediate panel operable to telescope from the second opposing side of the frame; one or more telescoping panels, each operable to telescope from a leading side of at least one intermediate panel; one or more lead folding panels, each operable to mount to a leading side of at least one telescoping panel; and one or more extension folding panels, each operable to mount to either an extended side of at least one lead folding panel or an extended side of another extension folding panel.

12 Claims, 14 Drawing Sheets

SYSTEMS AND METHODS FOR PROVIDING A DEPLOYABLE PERIMETER SECURITY APPARATUS

RELATED APPLICATION

The present application claims priority to U.S. Provisional Ser. No. 63/606,496, titled "SELF CONTAINED & RAPIDLY DEPLOYABLE PERIMETER SECURITY APPARATUS", filed Dec. 5, 2023, the contents of which are incorporated by reference.

FIELD OF DISCLOSURE

The present disclosure is related to security devices, and more particularly to, systems and methods for providing a deployable perimeter security apparatus.

BACKGROUND

Conventional portable or deployable protective barrier solutions can often require internal, external, or separately provided winch or lifting equipment for setup and breakdown.

In a related technology, a system and method for providing a mobile mission kit (MMK) can provide a deployable ballistic barrier solution that includes one or more panels that can be manually extended from a mobile crate, and the user has option to install a motorized deployment method dependent upon application.

Other conventional solutions can be time consuming to setup and deploy, while in many instances, these solutions may not be as versatile, durable, or otherwise effective in a variety of situations.

BRIEF SUMMARY OF DISCLOSURE

Embodiments of the disclosure can provide systems and methods for providing a deployable perimeter security apparatus. Certain embodiments of the disclosure can provide a flexible, self-contained, rapidly deployable perimeter security apparatus. In at least one embodiment of the disclosure, a deployable perimeter security apparatus can include one or more telescoping fence like panels that open (deploy) into a protective barrier within seconds upon arriving at designated location.

In one embodiment, a deployable perimeter security apparatus can include a frame with a box-shape, the frame comprising a first opposing side and a second opposing side; an anchor device operable to extend from a third side of the frame; a first intermediate panel operable to telescope from the first opposing side of the frame; a second intermediate panel operable to telescope from the second opposing side of the frame; one or more telescoping panels, each operable to telescope from a leading side of at least one intermediate panel; one or more lead folding panels, each operable to mount to a leading side of at least one telescoping panel; an one or more extension folding panels, each operable to mount to either an extended side of at least one lead folding panel or an extended side of another extension folding panel.

In one aspect of the embodiment, the anchor device can include one or more telescoping struts operable to extend from a retracted storage position to an extended deployed position, wherein, in the extended deployed position, the one or more telescoping struts facilitate supporting the frame in an upright position.

In one aspect of the embodiment, the anchor device can include a square U-shape with a pair of telescoping struts operable to extend from a retracted storage position to an extended deployed position, wherein, in the extended deployed position, the one or more telescoping struts facilitate supporting the frame in an upright position.

In one aspect of the embodiment, the anchor device can include one or more telescoping struts which, in a retracted storage position, facilitate positioning the one or more telescoping struts closely adjacent to the third side of the frame.

In one aspect of the embodiment, the first intermediate panel and second intermediate panel are operable to slide along one or more frame guides associated with an interior surface of the frame.

In one aspect of the embodiment, the one or more telescoping panels are operable to slide along one or more intermediate panel guides associated with a respective surface of the one or more intermediate panels.

In one aspect of the embodiment, the apparatus can further include at least one hinge to facilitate folding each of the one or more lead folding panels to be closely adjacent to a respective extension folding panel.

In one aspect of the embodiment, the apparatus can further include at least one hinge to facilitate folding each of the one or more extension folding panels to be closely adjacent to a respective extension folding panel.

In one aspect of the embodiment, the apparatus can further include a series of sharp devices mounted on an upper lateral surface of each of the first intermediate panel, second intermediate panel, one or more telescoping panels, one or more lead folding panels, and one or more extension folding panels.

In one aspect of the embodiment, wherein a fourth side of the frame, and at least one side of each of the first intermediate panel, second intermediate panel, one or more telescoping panels, one or more lead folding panels, and one or more extension folding panels comprise a ballistics resistant material.

In one embodiment, a method for installing a deployable perimeter security apparatus can be provided. The method can include positioning the apparatus comprising a frame with a box-shape, the frame comprising a first opposing side and a second opposing side; extending an anchor device from a third side of the frame; extending a first intermediate panel from the first opposing side of the frame; extending a second intermediate panel from the second opposing side of the frame; extending one or more telescoping panels from a leading side of each of the at least one intermediate panels; extending one or more lead folding panels from a leading side of each of the at least one telescoping panels; and extending one or more extension folding panels from either an extended side of at least one lead folding panel or from an extended side of another extension folding panel.

In one embodiment, a system can be provided. The system can include two or more deployable perimeter security apparatus, each apparatus including a frame with a box-shape, the frame comprising a first opposing side and a second opposing side; an anchor device operable to extend from a third side of the frame; a first intermediate panel operable to telescope from the first opposing side of the frame; a second intermediate panel operable to telescope from the second opposing side of the frame; one or more telescoping panels, each operable to telescope from a leading side of at least one intermediate panel; one or more lead folding panels, each operable to mount to a leading side of at least one telescoping panel; and one or more extension folding panels, each operable to mount to either an extended side of at least one lead folding panel or an extended side of another extension folding panel; wherein a first deployable perimeter security apparatus is operable to connect to a second deployable perimeter security apparatus, when respective extension folding panels are fully extended, and the respective extension folding panels are closely adjacent to each other.

BRIEF DESCRIPTION OF THE DRAWINGS

The detailed description is set forth with reference to the accompanying drawings. The drawings are provided for purposes of illustration only and merely depict exemplary embodiments of the disclosure. The drawings are provided to facilitate understanding of the disclosure and shall not be deemed to limit the breadth, scope, or applicability of the disclosure. In the drawings, the left-most digit(s) of a reference numeral may identify the drawing in which the reference numeral first appears. The use of the same reference numerals indicates similar, but not necessarily the same or identical components. However, different reference numerals may be used to identify similar components as well. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Figure 1:
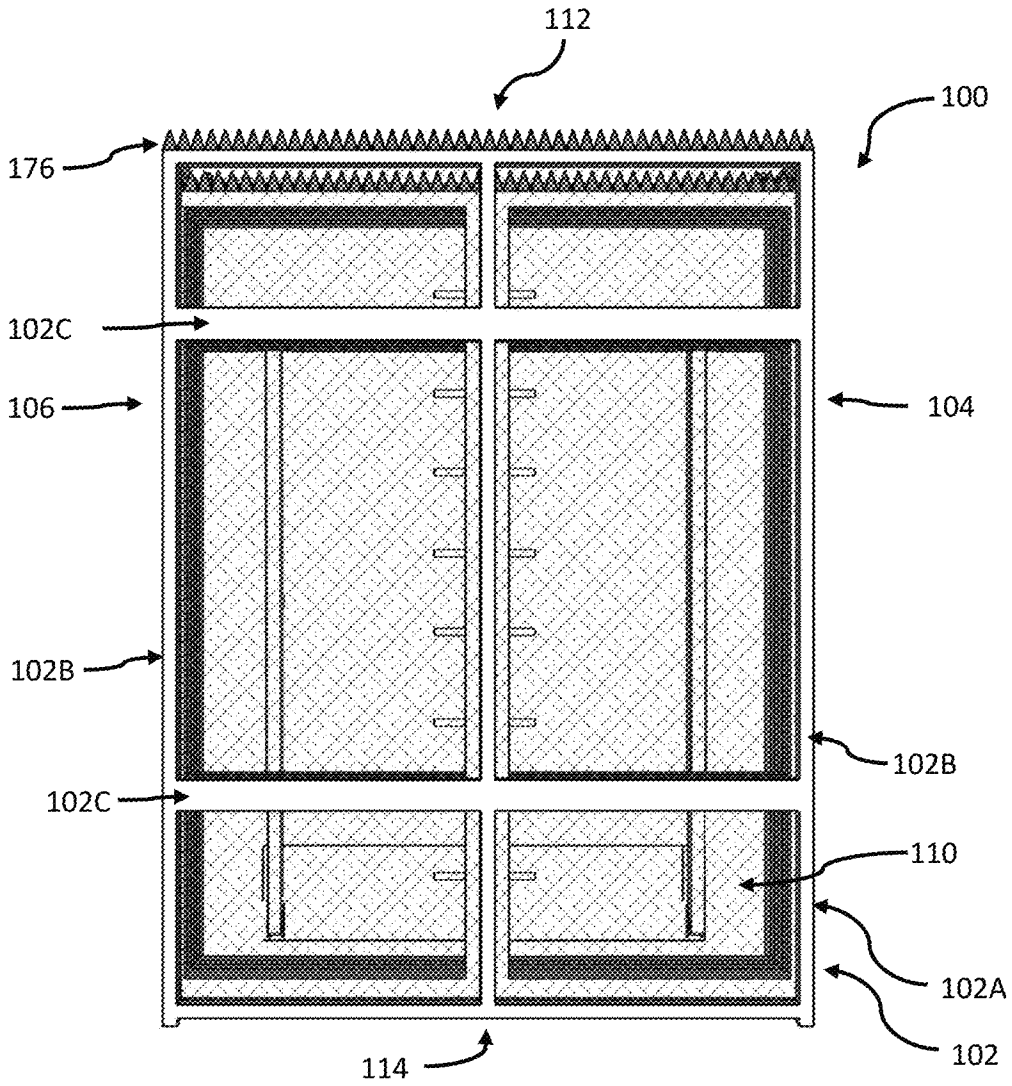
FIG. 1 illustrates a front view of an example deployable perimeter security apparatus in a storage or non-deployed configuration, according to an example embodiment of the disclosure.

This disclosure relates to, among other things, systems and methods for providing a deployable perimeter security apparatus. In one embodiment, a deployable perimeter security apparatus can include a frame with a box-shape, the frame comprising a first opposing side and a second opposing side; an anchor device operable to extend from a third side of the frame; a first intermediate panel operable to telescope from the first opposing side of the frame; a second intermediate panel operable to telescope from the second opposing side of the frame; one or more telescoping panels, each operable to telescope from a leading side of at least one intermediate panel; one or more lead folding panels, each operable to mount to a leading side of at least one telescoping panel; and one or more extension folding panels, each operable to mount to either an extended side of at least one lead folding panel or an extended side of another extension folding panel.

In certain embodiments, systems and methods can provide a cage/fence like apparatus or "Riot" configuration, with one or more self-contained articulating/telescoping panels that fit within the apparatus, which can be quickly stored, shipped, and/or deployed as needed. The apparatus can include a fold-up anchor or support for increased stability and anchoring of the apparatus. When fully deployed, the apparatus can provide an extended barrier or wall like structure that can protect a user and/or critical infrastructure from incoming ballistics, projectiles, shrapnel, or may be used for crowd control and directing desired traffic patterns. Each individual apparatus, when deployed, can be connected to an adjacent apparatus to form a linked perimeter barrier system. As needed, each apparatus can be designed and selected for a particular need or application. For example, an apparatus may be customized with certain desired or needed protective characteristics. Prior to shipping and locating an apparatus at a particular site, each apparatus can be customized with certain equipment and materials for specific needs or applications, for example, military specific operations, FEMA emergency and disaster response, communications platforms, MASH (military hospital) support diagnostic equipment and med-surg disposables, HAZMAT cleaning stations in response to chemical or radiation leaks, pandemic vaccination areas, crowd control and protection, temporary law enforcement command center needs, and for active shooter or riot situations, etc.

In one or more embodiments, the systems and methods described herein may improve upon conventional solutions where unlike other fence based systems that have to be packaged or crated, then shipped, opened at site, assembled, packaging debris removed to make room for work area, and connected to other similar units to create an extended barrier. The present systems, methods, and associated apparatus can provide technical solutions to ship an apparatus ready for use which can be immediately activated or otherwise manually deployed at destination locations and sites.

Figure 2:
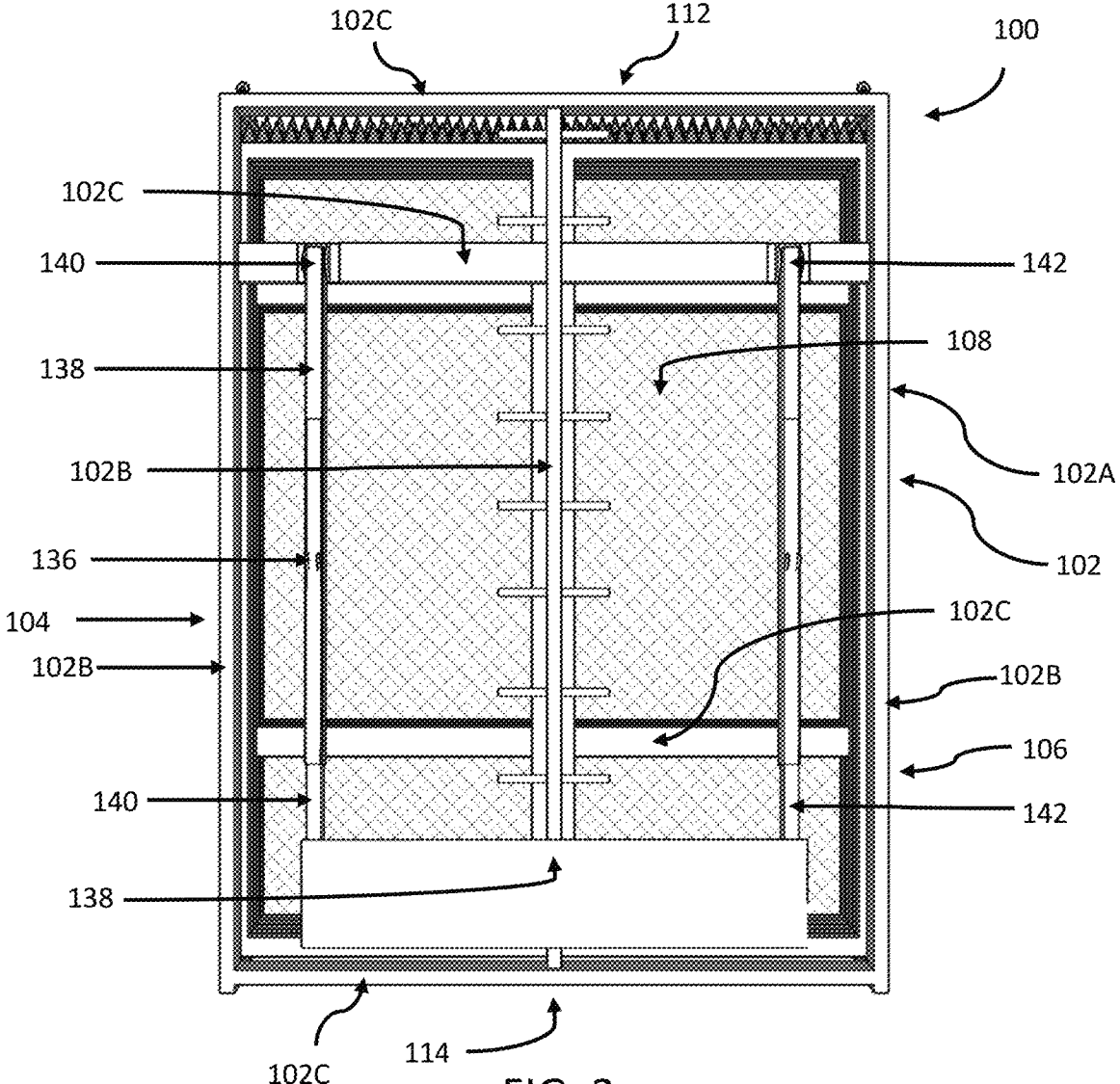
FIG. 2 illustrates a rear view of the example apparatus shown in FIG. 1, in a storage or non-deployed configuration.
Figure 3:
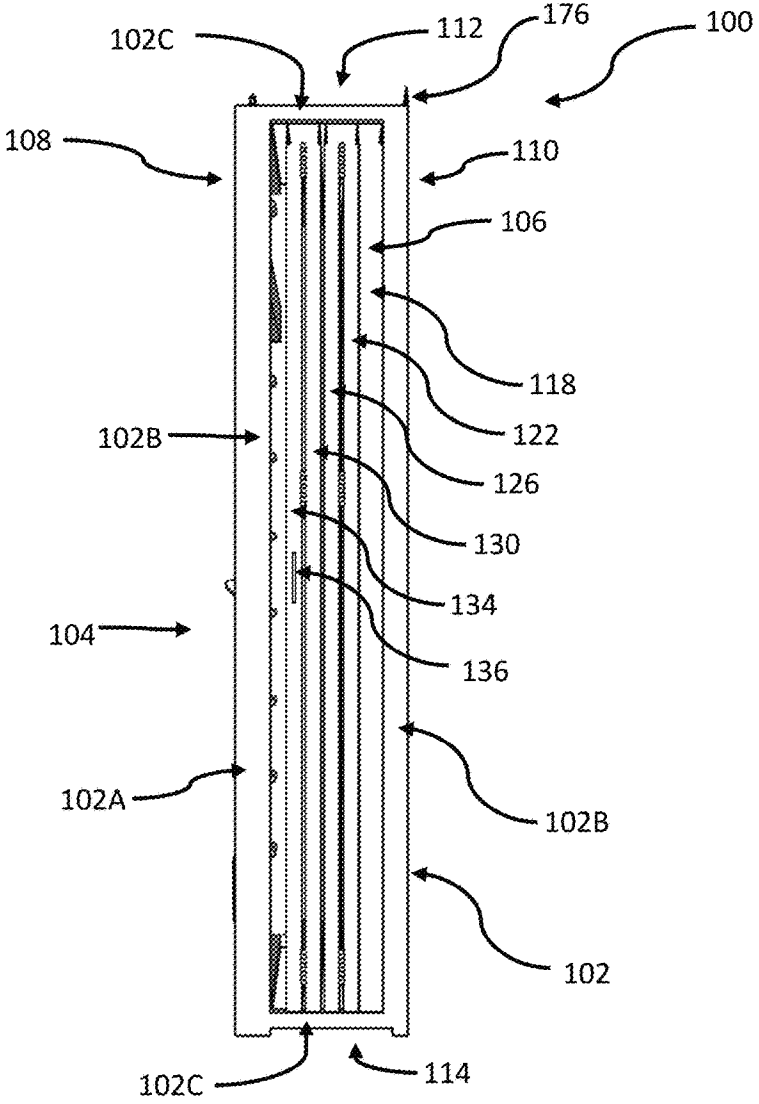
FIG. 3 illustrates a side view of the example apparatus shown in FIGS. 1-2, in a storage or non-deployed configuration.

FIGS. 1-3 illustrate views of an example deployable perimeter security apparatus in a storage or non-deployed configuration, according to an example embodiment of the disclosure. FIG. 1 illustrates a front view of the example apparatus, and FIG. 2 illustrates a rear view of the example apparatus shown in FIG. 1, in a storage or non-deployed configuration. FIG. 3 illustrates a side view of the example apparatus shown in FIGS. 1-2.

As shown in FIGS. 1-3, in one or more embodiments, the apparatus 100 can include a frame 102, which can be rectangular box-shaped. The frame 102 can include perimeter components 102A and any number of vertical cross-struts 102B, horizontal cross-struts 102C, and/or diagonal cross-struts. The perimeter components 102A form the outer shape of the frame 102, and the vertical cross-struts 102B, horizontal cross-struts 102C, and/or diagonal cross-struts can extend between adjacent perimeter components 102A to facilitate strengthening the frame 102. In one example, the frame 102 can be approximately 136 inches (3.45 meters) high, 90 inches (2.29 meters) wide, and 24 inches (0.61 meters) deep. The frame 102 can include a first opposing lateral side 104 and a second opposing lateral side 106. Between the lateral sides, a relatively wide rear side 108 and front side 110, that is, a third side and fourth side, comprise the other vertical sides of the frame 102. An upper side 112 and lower side 114 of the frame comprise the horizontal sides of the frame 102. In some instances, a ladder may be mounted to or otherwise incorporated in the rear side 108 of the frame 102 to permit a user to climb or otherwise access the upper side 112 of the frame 102. One skilled in the art will recognize that the frame 102 can be of various sizes and/or dimensions.

Within the frame 102, one or more panels can be configured to be stored for subsequent deployment by extending each of the panels outward from the frame 102. As shown in FIGS. 1-3, and by way of example, the apparatus 100 can include a first intermediate panel 116, a second intermediate panel 118, one or more telescoping panels 120, 122, one or more lead folding panels 124, 126, and one or more extension folding panels 128, 130. Any number of technologies can be used to connect adjacent panels as well as the first intermediate panel and second intermediate panel to the frame 102. Suitable technologies can include a cantilever track mechanism; a hinged, ball bearing, sliding pull-out mechanism; any other telescoping, articulating, bi-fold, and/or mechanical arm extension; or any other mechanical devices that can facilitate a desired telescoping and/or articulating action for any number of specific applications. In any instance, a desired technology can be selected and mounted to each panel, allowing for the connection to other adjacent panels, which permits connected adjacent panels to telescope, slide and/or articulate with respect to the apparatus 100 and/or frame 102. In certain instances, a cantilever track mechanism can be constructed from metal, steel, aluminum, aircraft aluminum, fiber resin polymer, or any other material or combinations thereof disclosed herein for a desired need or application.

Generally, each of the panels can be a relatively thin, rectangular-shaped component. When the panels are connected to each other, the panels can be telescoped and/or folded into a storage or non-deployed configuration, for example, as shown in FIGS. 1-3, and the folded panels can be arranged within the frame 102 for subsequent deployment.

In some instances, an exterior facing side of a panel, such as on a front side 110 of the apparatus 100 may be different than the opposing side of the panel. That is, a different material may be used on one side of the panel, or a different and separate panel component can be used. In this manner, an exterior facing side of a panel, such as on a front side 110 of the apparatus 100 can be "skinned" or otherwise customized for any desired need or purpose. Suitable materials for an exterior facing side of a panel, such as on a front side 110 of the apparatus 100, can include, but not limited to, polyurea, aluminum, aircraft aluminum, laminates, wood, veneers, fiber polymer resins, non-woven materials, kevlar, meta materials, Lexam, thermoplastic polyethylene polymer (TPP), UHMWPE (ultra high molecular weight polyethylene), any other type of material disclosed herein, or any combination thereof for any specific need or application.

The frame 102 can be made from any number of relatively durable materials including, but not limited to, aluminum, aircraft aluminum, steel, fiber resin polymer (FRP), plastic, titanium, meta materials, TPP, fiberglass resin polymers, kevlar, carbon fiber composite, acrylic, steel plate, polyurea coating, Lexam, UHMWPE, concrete, rubber, ballistic or projectile resistant material including those that meet or exceed NU and UL-752 ballistic resistant material test requirements (or greater protection levels), anti-climb or anti-scale fencing, combinations of anti-climb or anti-scale fencing with any deterrent technology, and any other combinations thereof depending on a specific need or application.

The first intermediate panel 116 can include perimeter components 116A and any number of vertical cross-struts and/or horizontal cross-struts 116B. The perimeter components 116A can form the outer shape of the first intermediate panel 116, and the vertical cross-struts, horizontal cross-struts 116B, and/or diagonal cross-struts can extend between adjacent perimeter components 116A to facilitate strengthening the first intermediate panel 116. In one example, the first intermediate panel 116 can be approximately 130 inches (3.30 meters) high, 45 inches (1.14 meters) wide, and 2 inches (0.051 meters) deep. One skilled in the art will recognize that the first intermediate panel 116 can be of various sizes, dimensions, and when deployed, can extend to various lengths.

The second intermediate panel 118 can include perimeter components 118A and any number of vertical cross-struts, horizontal cross-struts 118B, and/or diagonal cross-struts. The perimeter components 116A can form the outer shape of the first intermediate panel 118, and the vertical cross-struts, horizontal cross-struts 118B, and/or diagonal cross-struts can extend between adjacent perimeter components 118A to facilitate strengthening the first intermediate panel 118. In one example, the second intermediate panel 118 can be approximately 130 inches (3.30 meters) high, 45 inches (1.14 meters) wide, and 2 inches (0.051 meters) deep. One skilled in the art will recognize that the second intermediate panel 118 can be of various sizes, dimensions, and when deployed, can extend to various lengths.

The telescoping panels 120, 122 can include respective perimeter components 120A, 122A and any number of respective vertical cross-struts, horizontal cross-struts 120B, 122B, and/or diagonal cross-struts. The perimeter components 120A, 122A can form the outer shape of the respective telescoping panels 120, 122, and the respective vertical cross-struts, horizontal cross-struts 120B, 122B, and/or diagonal cross-struts can extend between adjacent perimeter components 120A, 122A to facilitate strengthening the telescoping panels 120, 122. In one example, the telescoping panels 120, 122 can be approximately 130 inches (3.30 meters) high, 45 inches (1.14 meters) wide, and 2 inches (0.051 meters) deep. One skilled in the art will recognize that the telescoping panels 120, 122 can be of various sizes, dimensions, and when deployed, can extend to various lengths.

The lead folding panels 124, 126 can include respective perimeter components 124A, 126A and any number of respective vertical cross-struts, horizontal cross-struts, and/or diagonal cross-struts. The perimeter components 124A, 126A can form the outer shape of the respective lead folding panels 124, 126, and the respective vertical cross-struts, horizontal cross-struts, and/or diagonal cross-struts can extend between adjacent perimeter components 124A, 126A to facilitate strengthening the lead folding panels 124, 126. In one example, the lead folding panels 124, 126 can be approximately 130 inches (3.30 meters) high, 45 inches (1.14 meters) wide, and 2 inches (0.051 meters) deep. One skilled in the art will recognize that the lead folding panels 124, 126 can be of various sizes, dimensions, and when deployed, can extend to various lengths.

The extension folding panels 128, 130 can include respective perimeter components 128A, 130A and any number of respective vertical cross-struts, horizontal cross-struts, and/or diagonal cross-struts. The perimeter components 128A, 130A can form the outer shape of the respective extension folding panels 128, 130, and the respective vertical cross-struts, horizontal cross-struts, and/or diagonal cross-struts can extend between adjacent perimeter components 128A, 130A to facilitate strengthening the extension folding panels 128, 130. In one example, the extension folding panels 128, 130 can be approximately 130 inches (3.30 meters) high, 45 inches (1.14 meters) wide, and 2 inches (0.051 meters) deep. One skilled in the art will recognize that the extension folding panels 128, 130 can be of various sizes, dimensions, and when deployed, can extend to various lengths. The end folding panels 132, 134 can include respective perimeter components 132A, 134A and any number of respective vertical cross-struts, horizontal cross-struts, and/or diagonal cross-struts. The perimeter components 132A, 134A can form the outer shape of the respective extension folding panels 132, 134, and the respective vertical cross-struts, horizontal cross-struts, and/or diagonal cross-struts can extend between adjacent perimeter components 132A, 134A to facilitate strengthening the extension folding panels 132, 134. In one example, the end folding panels 132, 134 can be approximately 130 inches (3.30 meters) high, 45 inches (1.14 meters) wide, and 2 inches (0.051 meters) deep. One skilled in the art will recognize that the end folding panels 132, 134 can be of various sizes, dimensions, and when deployed, can extend to various lengths.

Similar to the frame 102, the perimeter components and associated cross-struts of the panels 116, 118, 120, 122, 124, 126, 128, 130, 132, 134 can be made from any number of relatively durable materials including, but not limited to, aluminum, aircraft aluminum, steel, fiber resin polymer (FRP), plastic, titanium, meta materials, TPP, fiberglass resin polymers, kevlar, carbon fiber composite, acrylic, steel plate, polyurea coating, Lexam, UHMWPE, concrete, rubber, ballistic or projectile resistant material including those that meet or exceed NU and UL-752 ballistic resistant material test requirements (or greater protection levels), anti-climb or anti-scale fencing, combinations of anti-climb or anti-scale fencing with any deterrent technology, and any other combinations thereof depending on a specific need or application.

Positioned between the respective perimeter components of each of the front side 110 or fourth side of the frame 102, the first intermediate panel 116, second intermediate panel 118, telescoping panels 120, 122, lead folding panels 124, 126, extension folding panels 128, 130, and end folding panels 132, 134 can be a relatively thin but resilient sheet of durable material, such as any of the materials disclosed herein depending on a desired need or application. Generally, the sheet of durable material extends between the perimeter of each panel. In some instances, a ballistic resistant panel and/or other ballistics resistant grade materials or combinations thereof can be used. Generally, sheets of durable material can generally be fabricated into rectangular-shaped sections designed to quickly mount to and/or between the respective perimeter components of the various panels to create a desired protection level for the apparatus 100. The sheets of durable materials can be affixed to the various panels and/or frame 100 using conventional methodologies including, but not limited to, nuts-and-bolts, rivets, or other products suitable for specific need or application.

Figure 4:
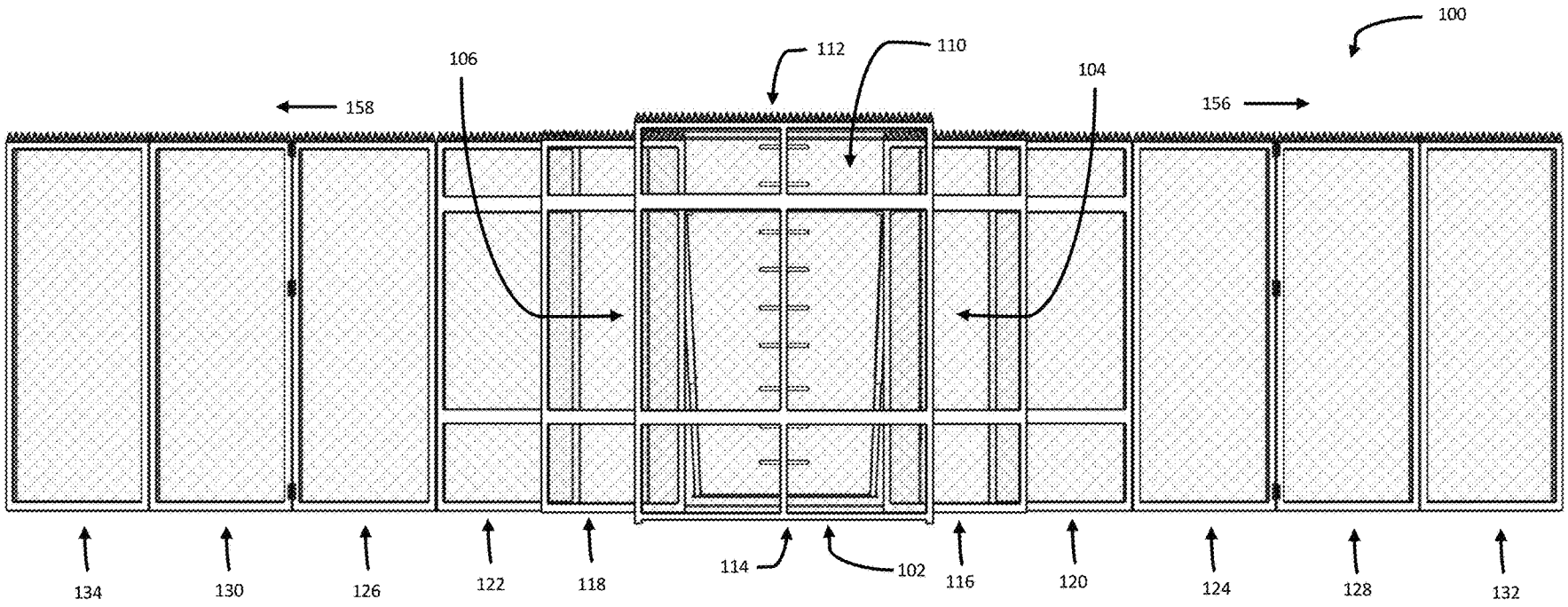
FIG. 4 illustrates a front view of the example apparatus shown in FIGS. 1-3, in an activated or deployed configuration, according to an example embodiment of the disclosure.
Figure 5:
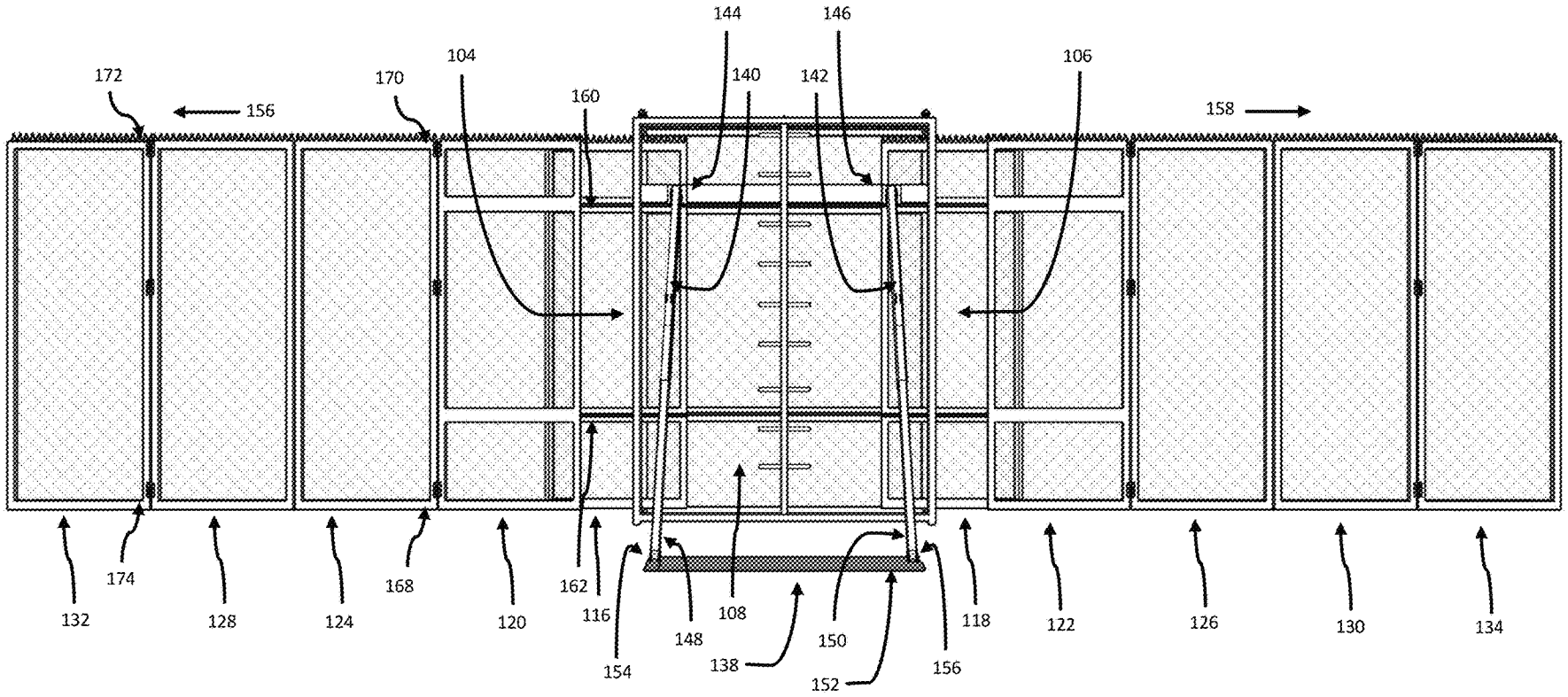
FIG. 5 illustrates a rear view of the example apparatus shown in FIG. 4, in an activated or deployed configuration.
Figure 6:
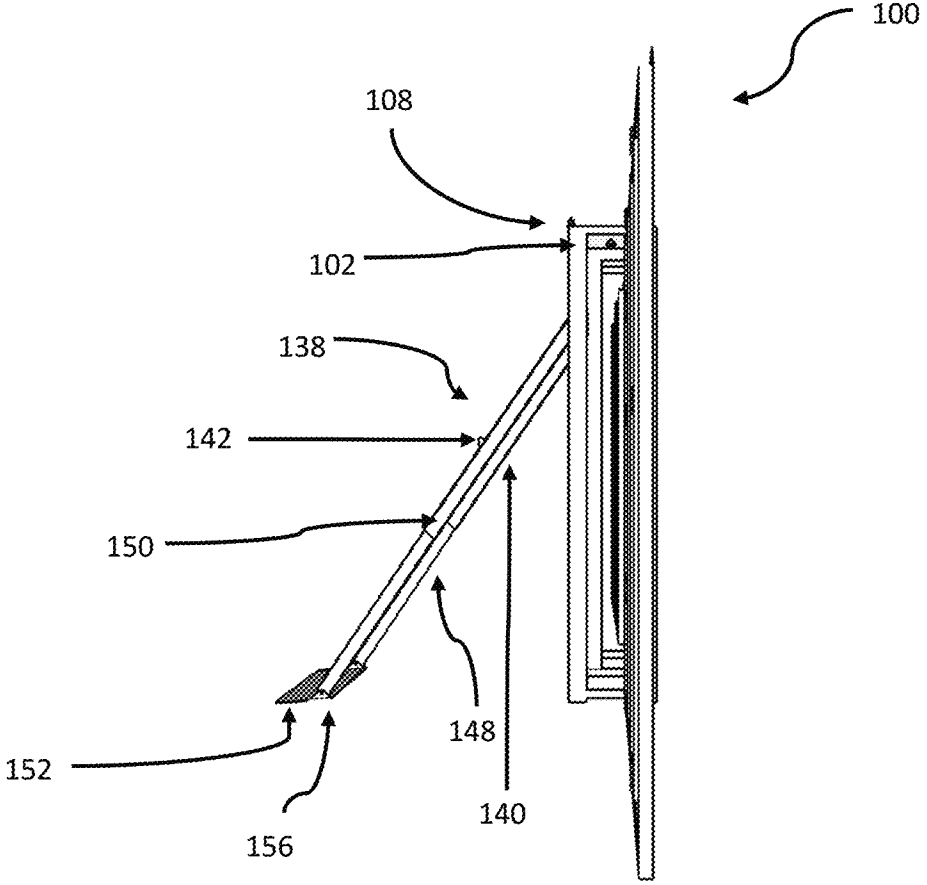
FIG. 6 illustrates a side view of the example apparatus shown in FIGS. 4-5, in an activated or deployed configuration.

As shown in FIGS. 1-3, a handle 136 can be provided for a user to manually grip at least one of the panels, such as an end folding panel 132, 134 to pull some or all of the adjacent connected panels outward from the frame 102. As the user continues pulling the handle 136, the end folding panel 132, 134 and any adjacent connected panels can articulate and/or telescope outward and away from the frame 102 to position the end folding panel 132, 134 and any adjacent connected panels of the apparatus 100 in a deployed configuration, as seen in FIGS. 4-6. An extended barrier wall can be created by manually pulling on the handle 136 of a panel positioned inside the apparatus 100 and/or frame 102.

In some instances, one or more handles, similar to 136, can be embedded and/or mounted to some or all of the other adjacent connected panels. Such handles can be telescoping and/or articulating handles, or pull loops, that can be made from the same material as the panel components, panel material or skins, or any other material disclosed herein depending on a desired need or application.

Further, as shown in FIGS. 1-6, an anchor mechanism or anchor device 138 can mount to a rear side 108 or third side of the frame 102. In the example shown, the anchor device 138 can be a square U-shape with a pair of telescoping struts 140, 142 operable to extend from a retracted storage position to an extended deployed position, wherein, in the extended deployed position, the telescoping struts 140, 142 can facilitate supporting the apparatus 100 and/or frame 102 in a relatively upright position. The upper portion of the anchor device 138 can include the 2 open ends of the square U-shape, which are the upper ends of the telescoping struts 140, 142. The upper ends of the struts 140, 142 can be mounted to the frame 102 with respective hinges 144, 146 to facilitate rotation of the anchor device 138 from a relatively vertical position, when in a storage or undeployed configuration, shown in FIGS. 1-3, to an angled position when in a deployed configuration, shown in FIGS. 4-6.

Further, the telescoping struts 140, 142 can include respective extendable sections 148, 150, which are operable to extend from a retracted storage position to an extended deployed position. In this example, the extendable sections 148, 150 can be sized to fit within the internal section of respective telescoping struts 140, 142, wherein, when the extendable sections 148, 150 are in the extended deployed position, shown in FIGS. 4-6, the one or more telescoping struts 140, 142 can facilitate supporting the apparatus 100 and/or frame 102 in a relatively upright position. Conversely, when the extendable sections 148, 150 are in a retracted storage position, shown in FIGS. 1-3, the one or more telescoping struts 140, 142 can permit the anchor device 138 to be rotated into a relatively vertical orientation to be closely adjacent to the rear side 108 or third side of the frame 102.

Further, the anchor device 138 can include a footer strut 152 that can form the closed end of the square U-shape of the anchor device 138. That is, the footer strut 152 can be an elongated plate that extends between the telescoping struts 140, 142 Each end of the footer strut 152 can mount to a respective end of the extendable sections 148, 150 of the struts 140, 142 via respective hinges 154, 156. When the anchor device 138 is rotated to an angled or deployed configuration, the footer strut 152 facilitates increased stability in the anchor device 134 to maintain the apparatus 100 and/or frame 102 in a relatively upright position.

In some embodiments, the anchor device 138 can include one or more cross-struts, such as 158, that can extend between the telescoping struts 140, 142 and/or extendable sections 148, 150 to facilitate additional increased stability in the anchor device 138 to maintain the apparatus 100 and/or frame 102 in a relatively upright position. The cross-struts, such as 158, can also function as a handle for a user to manually rotate and/or deploy the anchor device 138 with respect to the apparatus 100 and/or frame 102.

Further, in some embodiments, the anchor device 138 can include a relatively large and heavy footer, such as a Jersey barrier, that can mount to or replace the footer strut 152 as needed, if additional stability in the anchor device 138 is needed. In one embodiment, a contoured concrete block can be used as a relatively large and heavy footer.

Figures 7A, 7B:
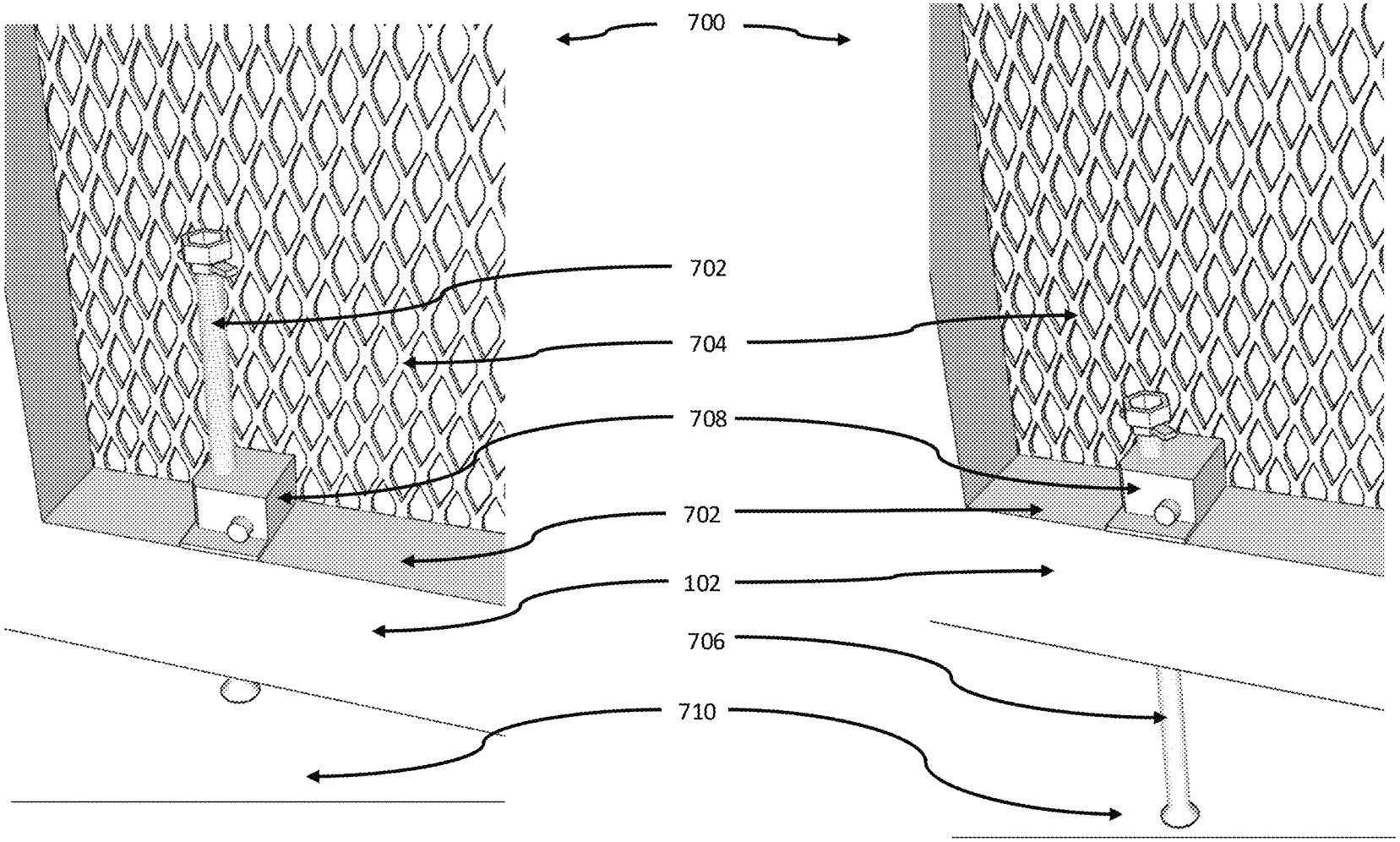
FIGS. 7A and 7B illustrate detailed views of another example anchor mechanism for the example apparatus of FIGS. 1-6, according to an example embodiment of the disclosure.

FIGS. 7A and 7B illustrate detailed views of another example anchor mechanism for the example apparatus of FIGS. 1-6, according to an example embodiment of the disclosure. In this embodiment, the anchor mechanism or dropdown anchor device 700 can be mounted to one or more of the panels, frame 102 and/or apparatus 100. As shown in FIG. 7A, the dropdown anchor device 700 can be mounted on a horizontal strut 702 of a panel 704 or the frame 102. The dropdown anchor device 700 can include an elongated rod 706 that can slide upward and downward as needed through a hole machined through the horizontal strut 702 of a panel 704 or the frame 102. A quick release mechanism 708 can permit the rod 702 to be fixed in a stationary storage or non-deployed position until activated, at which time, the quick release mechanism 708 can be manually actuated to permit the rod 702 to slide downward to contact the ground or floor 710 beneath the panel or frame, as shown in FIG. 7B. An associated hand tool, such as a socket wrench, can be used to rotate the rod 702 to tighten the rod 702 with respect to the quick release mechanism 708 to maintain the position of the rod 702 with respect to the horizontal strut 706. When needed, the rod 702 can be rotated in the opposing direction to loosen the rod 702 to permit the rod 702 to slide upward, until the quick release mechanism 708 maintains the rod 702 again in a fixed stationary storage or non-deployed position. One skilled in the art will recognize that other configurations for an anchor mechanism can be used with the apparatus 100.

Turning to use and/or deployment of the apparatus 100, FIGS. 4-6 illustrate a perspective view of the deployable perimeter security apparatus of FIGS. 1-3, in an activated or deployed configuration, according to an example embodiment of the disclosure. FIG. 4 illustrates a front perspective view of the apparatus, and FIG. 5 illustrates a rear perspective view of the apparatus shown in FIGS. 1-3, in an activated or deployed configuration. FIG. 6 illustrates a side view of the apparatus shown in FIGS. 4-5.

As described in FIGS. 1-3, the apparatus 100 can include a first intermediate panel 116, a second intermediate panel 118, one or more telescoping panels 120, 122, one or more lead folding panels 124, 126, one or more extension folding panels 128, 130, and one or more end folding panels 132, 134 The first intermediate panel 116 can telescope in a first direction 156 outward from the first opposing lateral side 104 of the frame 102, and the second intermediate panel 118 can telescope in an opposing or opposite direction 158 outward from the second opposing lateral side 106 of the frame 102. The first intermediate panel 116 and second intermediate panel 118 can be configured to slide with respect to the frame 102 along respective guides 160, 162, detailed further in FIG. 8.

Next, a respective telescoping panel 120, 122 can mount to an outward leading side of the first intermediate panel 116 and second intermediate panel 118. The first telescoping panel 120 can telescope in a first direction 156 outward from the first intermediate panel 116, and the second telescoping panel 122 can telescope in an opposite or second direction 158 from the second intermediate panel 118. The first telescoping panel 120 and second telescoping panel 122 can be configured to slide with respect to the respective first intermediate panel 116 and second intermediate panel 118 along respective guides 164, 166, detailed further in FIG. 8.

Moreover, respective lead folding panels 124, 126 can mount to an outward leading side of the first telescoping panel 120 and second telescoping panel 122. The first lead folding panel 124 can rotate to extend in a first direction 156 outward from the first telescoping panel 120, and the second lead folding panel 126 can rotate to extend in an opposite or second direction 158 from the second telescoping panel 122. The first lead folding panel 124 and second lead folding panel 126 can be configured to rotate and extend with respect to the respective first telescoping panel 120 and second telescoping panel 122 via respective one or more hinges 168, 170, detailed further in FIG. 9.

Next, respective extension folding panels 128, 130 can mount to an outward leading side of the first lead folding panel 124 and second lead folding panel 126. The first extension folding panel 128 can rotate to extend in a first direction 156 outward from the first lead folding panel 124, and the second extension folding panel 130 can rotate to extend in an opposite or second direction 158 from the second lead folding panel 126. The first extension folding panel 128 and second extension folding panel 130 can be configured to rotate and extend with respect to the respective first lead folding panel 124 and second lead folding panel 126 via respective one or more hinges 172, 174, detailed further in FIG. 9.

Finally, respective end folding panels 132, 134 can mount to an outward leading side of the first extension folding panel 128 and second extension folding panel 130. Note that each end folding panel 132, 134 can have a similar arrangement as an extension folding panel 128, 130. In any instance, the first end folding panel 132 can rotate to extend in a first direction 156 outward from the first extension folding panel 128, and the second end folding panel 134 can rotate to extend in an opposite or second direction 158 from the second extension folding panel 130. The first end folding panel 132 and second end folding panel 134 can be configured to rotate and extend with respect to the respective first extension folding panel 128 and second extension folding panel 130 via respective one or more hinges 172, 174, detailed further in FIG. 9.

As needed, one or more additional extension folding panels similar to 128, 130 can mount to an outward leading side of an adjacent extension folding panel similar to 128, 130. The additional extension folding panels can rotate as needed to extend in a first direction 156 outward from the adjacent extension folding panel, or can rotate to extend in an opposite or second direction 158 from the adjacent extension folding panel. The additional extension folding panels can be configured to rotate and extend with respect to the adjacent extension folding panel and via respective one or more hinges similar to those detailed further in FIG. 9. In this manner, the perimeter barrier formed by an apparatus 100 in a deployed configuration can be extended as needed.

Further, an apparatus 100 can be retrofitted at any point with any number of different configurations, such as different protection degrees for some or all of the panels and/or apparatus 100. In one example, some or all of the panels and/or apparatus 100 can include microwave and/or frequency energy wave absorbing materials to protect a user from microwave and/or frequency energy weapons. In any instance, any number of security enhancements can be utilized with the apparatus 100 including mounting a series of sharp devices, such as 176, on an upper lateral surface of each of the first intermediate panel, second intermediate panel, one or more telescoping panels, one or more lead folding panels, and one or more extension folding panels. These sharp devices 176 can be spike-shaped, or designed to deter a person from attempting to climb over or otherwise mounting an upper surface of the apparatus 100 when in a deployed configuration.

Further, some or all of the panels can include a ballistic resistant kick-plate positioned at a lower portion of each panel. The kick-plate can be mounted to the respective panel, and when deployed, can be flipped downward to be perpendicular with ground and/or lower edge of the panel, thus protecting lower extremities from incoming ballistics, shrapnel, debris, and other relatively harmful collateral. In one embodiment, the kick-plate and plate mounting mechanisms can be constructed from similar materials as disclosed above.

In some embodiments, an apparatus 100 can include a mantrap feature suitable for checkpoint applications where questionable suspects can be contained within the apparatus 100, and subsequently searched with a metal detector and/or X-ray equipment until law enforcement can safely address, or make contact with the contained person.

Figure 8:
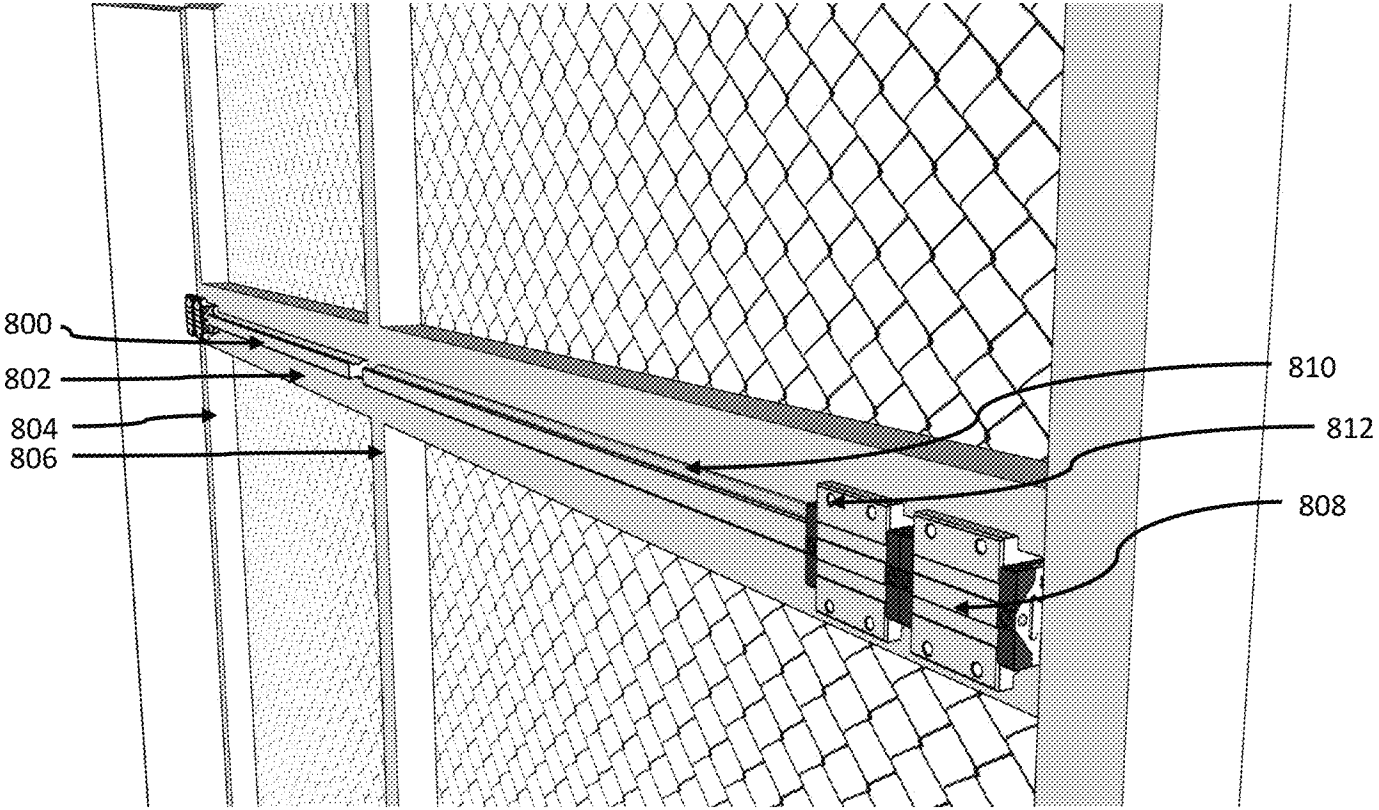
FIG. 8 illustrates a detailed view of an example guide mechanism of the apparatus shown in FIGS. 1-6, according to an example embodiment of the disclosure.

FIG. 8 illustrates a detailed view illustrating an example guide mechanism of the apparatus shown in FIGS. 1-6, according to an example embodiment of the disclosure. In this example, a frame guide or horizontal track 800 is mounted along a horizontal strut 802 and/or between adjacent perimeter components 804, 806 associated with an apparatus 100 and/or frame 102. One or more block mounts 808 can be configured with a respective groove 810 to permit each block mount 808 to mount to a corresponding structure 812 on the track 800. When the block mount 808 is mounted to the corresponding structure 812, the weight of the block mount 812 is loaded or otherwise cantilevered on the track 800 by way of the interaction between the groove 810 of the block mount on the corresponding structure 812 of the track 800. A panel 814, such as a first intermediate panel 116 or second intermediate panel 118, can connect to the block mounts 808 using a series of connectors, such as machine bolts or mounting screws. In some instances, a block mount such as 808 and/or groove 810 can be an integral part of or otherwise formed on the panel 814, and the corresponding structure 812 and frame guide or horizontal track 800 can be an integral part of or otherwise formed on the apparatus 100 and/or frame 102. In this manner, some or all of the weight of the panel 814, such as a first intermediate panel or second intermediate panel, can also transfer to and be supported by the track 800, and permit the panel 814 to slide along the frame guide or track 800 with respect to the apparatus 100 and/or frame 102.

Figure 9:
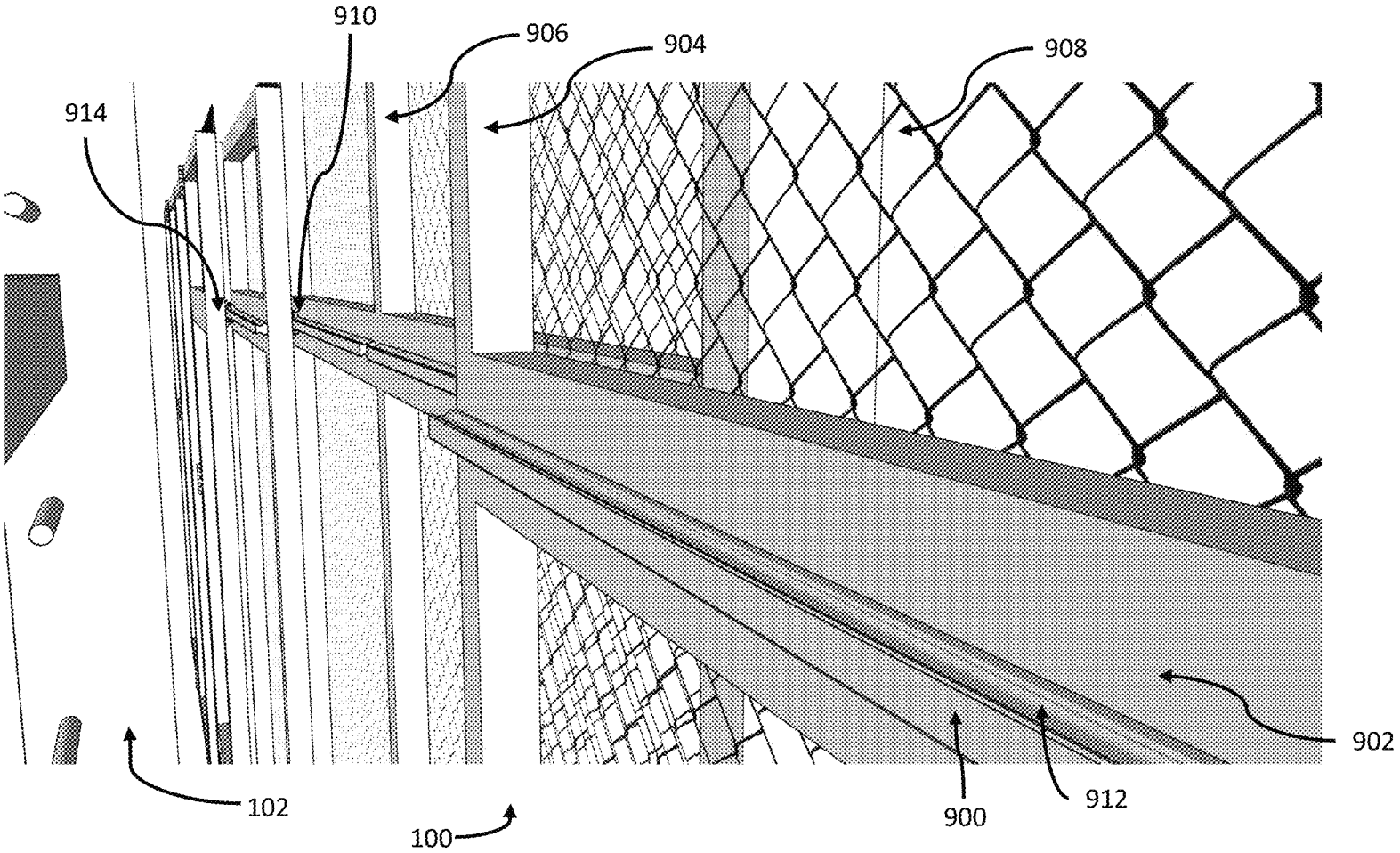
FIG. 9 illustrates a detailed view of another example guide mechanism of the apparatus shown in FIGS. 1-6, according to an example embodiment of the disclosure.

FIG. 9 illustrates a detailed view illustrating another example guide mechanism of the apparatus shown in FIGS. 1-6, according to an example embodiment of the disclosure. In this example, an intermediate panel guide or horizontal protruding track 900 can be mounted along a horizontal strut 902 and/or between adjacent perimeter components 904, 906 associated with a panel 908, an apparatus 100 and/or frame 102. One or more block mounts 910 can be configured with a respective groove 912 to permit each block mount 910 to mount to a corresponding structure 914 on the track 800. When the block mount 910 is mounted to the corresponding structure 914, some or all of the weight of the block mount 910 is loaded or otherwise cantilevered on the track 900 by way of the interaction between the groove 912 of the block mount 910 and the corresponding structure 914 of the track 900. A panel 908, such as a telescoping panel 120, can connect to the block mounts 910 using a series of connectors, such as machine bolts or mounting screws. In some instances, a block mount such as 910 and/or groove 912 can be an integral part of or otherwise formed on the panel 908, and the corresponding structure 914 and intermediate panel guide or horizontal track 900 can be an integral part of or otherwise formed on the intermediate panels 116, 118, apparatus 100 and/or frame 102. In any instance, in this manner, some or all of the weight of the panel 908, such as telescoping panel 120, 122, can also transfer to and be supported by the track 900, and permit the panel 908 to slide along the intermediate panel guide or track 900 with respect to the intermediate panels 116, 118, apparatus 100 and/or frame 102.

Figure 10:
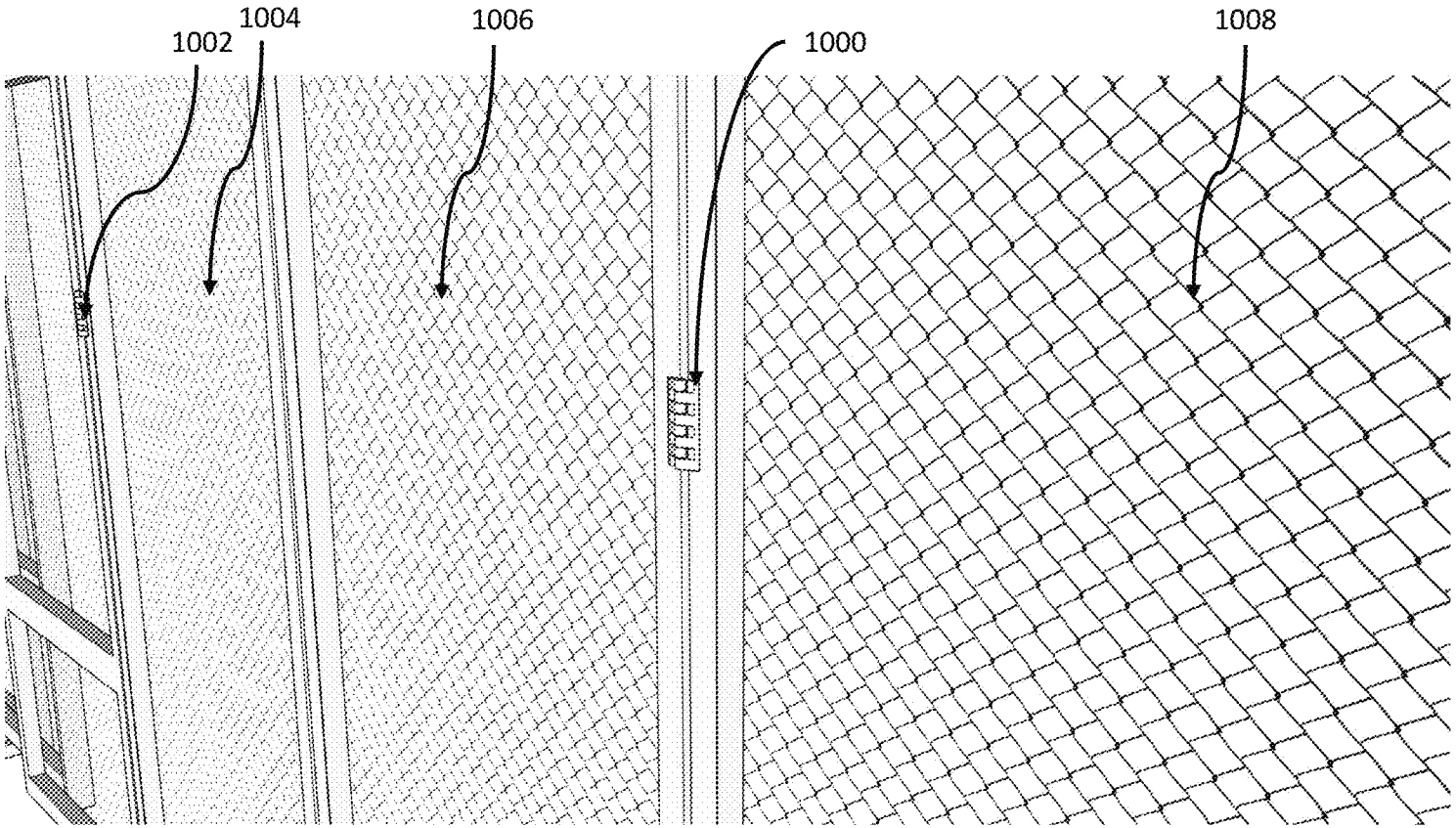
FIG. 10 illustrates a detailed view of an example hinge mechanism of the apparatus shown in FIGS. 1-6, according to an example embodiment of the disclosure.

FIG. 10 illustrates a detailed view illustrating an example hinge mechanism of the apparatus shown in FIGS. 1-6, according to an example embodiment of the disclosure. The example hinge mechanism in FIG. 10 can be a conventional type hinge 1000 with a first hinge component 1002 mounted to one panel 1004, and a second hinge component 1006 mounted to an adjacent panel 1008. The hinge components 1002, 1006 cooperate with each other to permit the one panel 1004 to rotate, translate, or otherwise articulate with respect to the adjacent panel 1008. For example, a hinge 1000 can permit a lead folding panel to rotate, translate, or otherwise articulate with respect to an extension folding panel. By way of another example, a hinge 1000 can permit an extension folding panel to rotate, translate, or otherwise articulate with respect to an adjacent extension folding panel.

Figure 11:
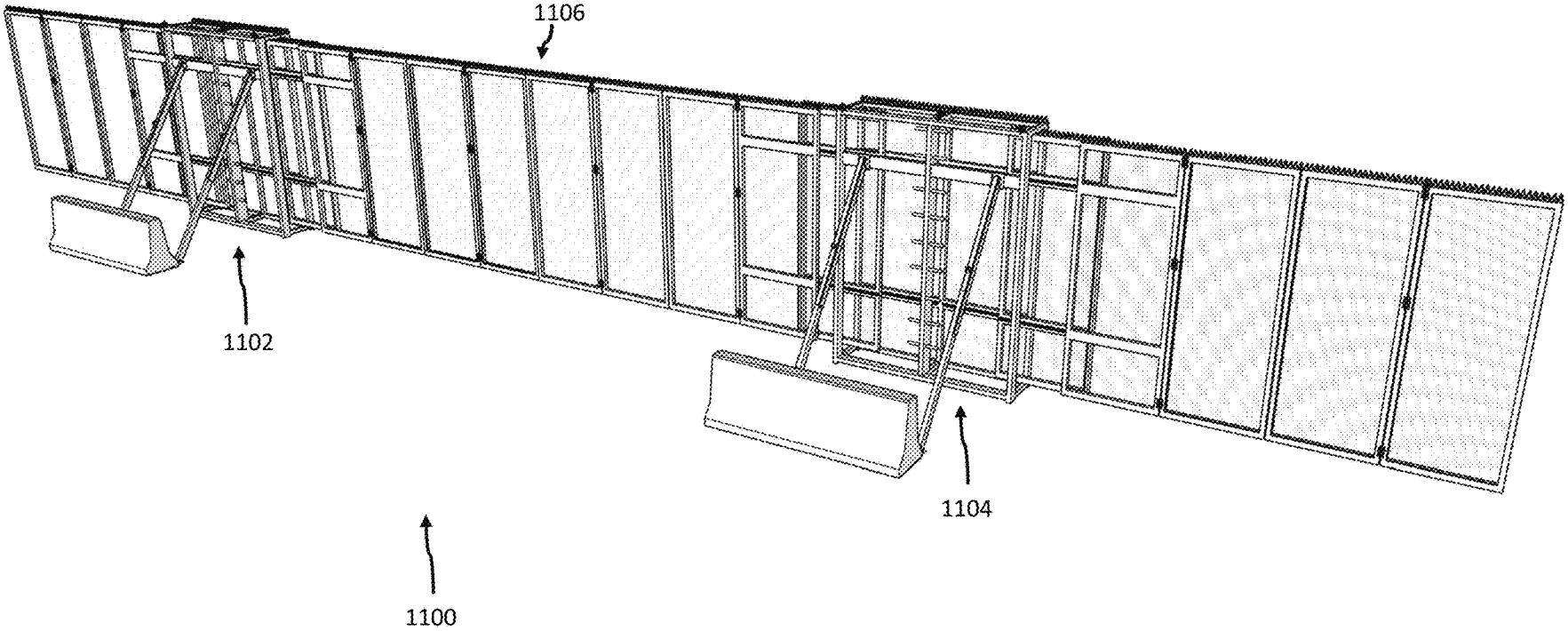
FIG. 11 illustrates a first example deployment of the example apparatus of FIGS. 1-6 to provide an extended barrier in an example environment, according to an example embodiment of the disclosure.

FIG. 11 illustrates an example deployment of the apparatus of FIGS. 1-6 to provide an extended barrier in an example environment, according to an example embodiment of the disclosure. In the embodiment shown as 1100, multiple apparatus 1102, 1104 can be utilized to establish a perimeter barrier 1106 for a temporary or longer-term base of operations by joining telescoping/articulating barrier panels together creating a fenced fortification, such as a four wall or surrounding protective area of operations. The self-contained and rapidly deployable perimeter security apparatus telescoping/articulating panels protect a user, such as "base camp" personnel and/or operators, by creating a protective fenced barrier between them and instigators/bad actors. In some instances. multiple connected apparatus 1102, 1104 can function as a temporary protective perimeter structure while fortified hard structures are erected and/or constructed. Further, in some instances, multiple connected apparatus 1102, 1104 can provide a protective barrier for crowd control purposes like concert venues or conventions by configuring customizable patterns that can facilitate control over crowd traffic patterns in/out of venues. In some instances, multiple connected apparatus 1102, 1104 can be deployed for use during times of civil unrest, for high profile events, venues, stadiums, coliseums, etc. In some instances, multiple connected apparatus 1102, 1104 can be safely transported via various truck types, ocean vessels, airlifted and air-dropped for military applications, and put into position at site destination utilizing crate, pallet or storage moving equipment.

Figure 12:
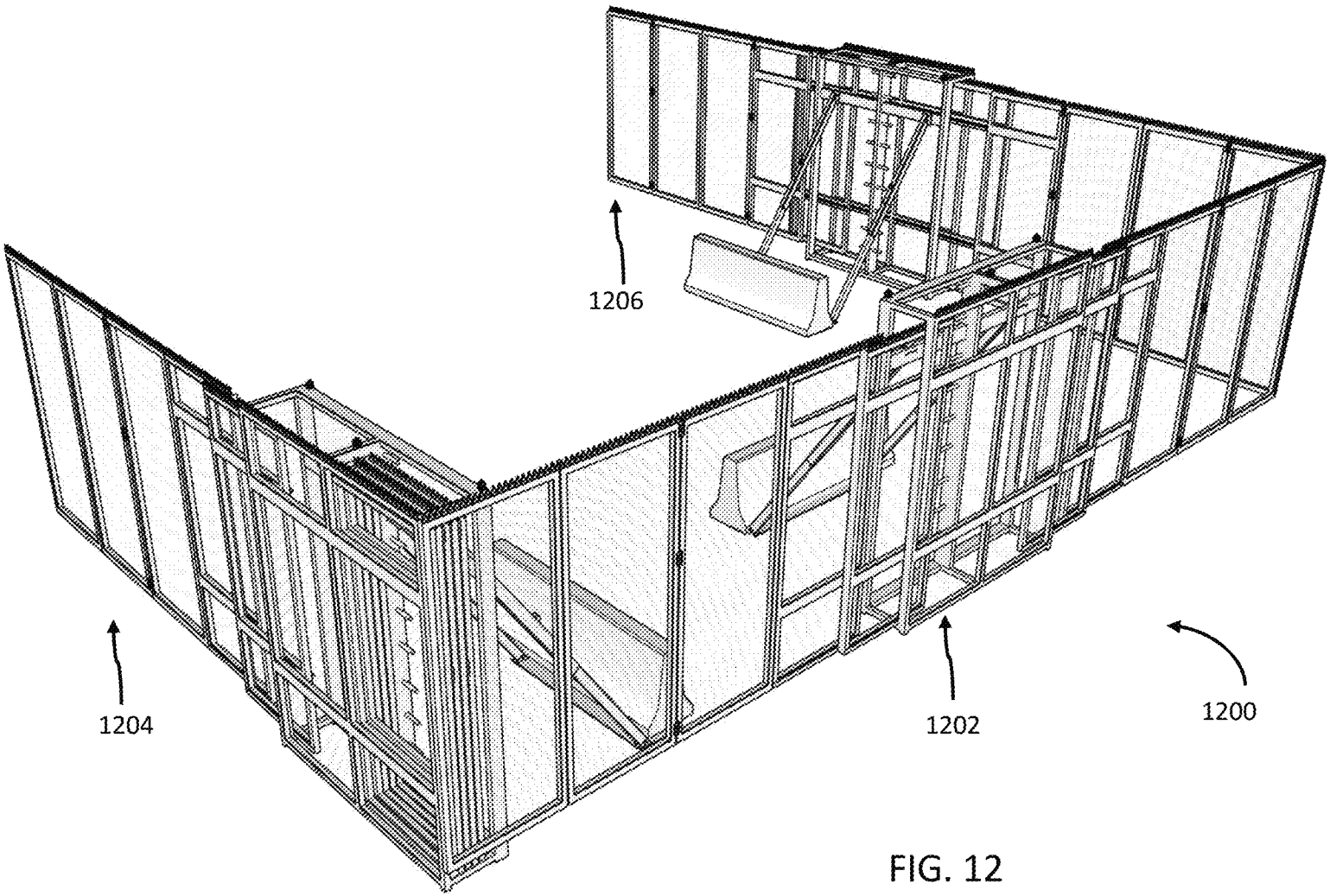
FIGS. 12 and 13 illustrate other example deployment of the example apparatus of FIGS. 1-6 to provide an extended barrier in other example environments, according to example embodiments of the disclosure.
Figure 13:
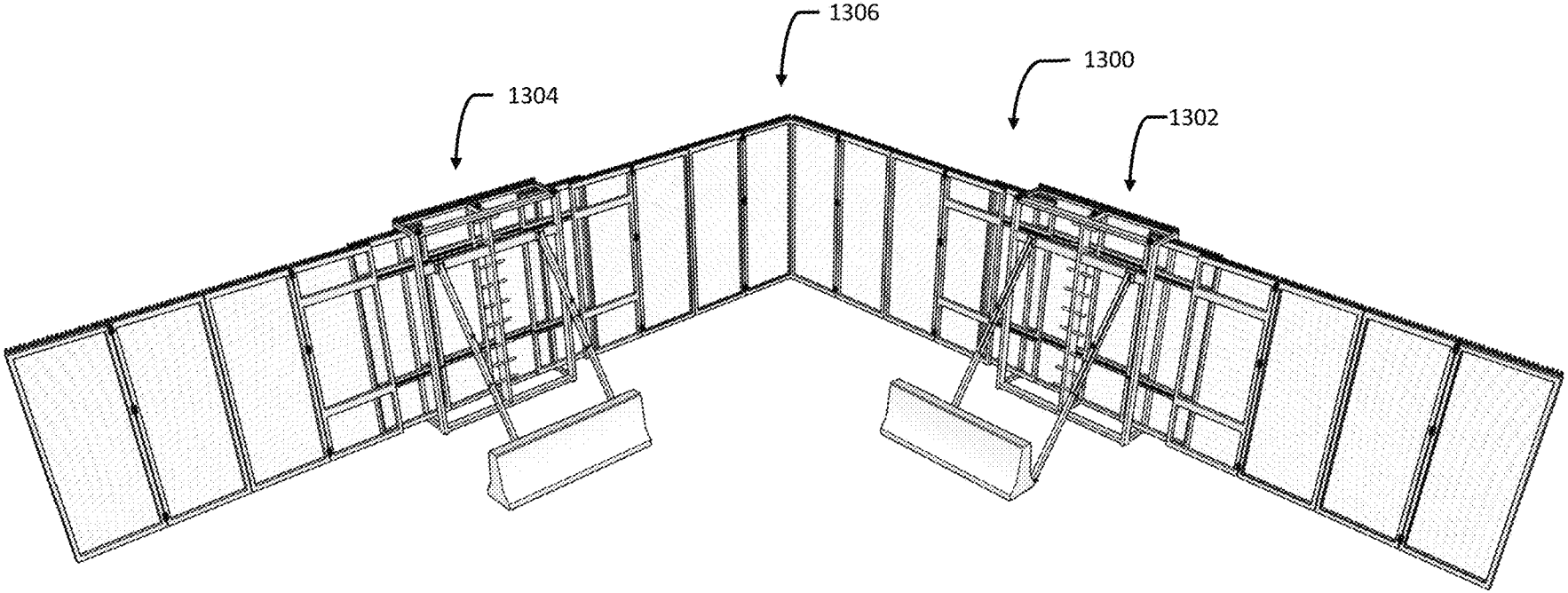

FIGS. 12 and 13 illustrate other example deployments of multiple apparatus of FIGS. 1-6 to provide an extended barrier in another example environment, according to an example embodiment of the disclosure. In the embodiments shown as 1200 and 1300, multiple apparatus 1202, 1204, 1302, 1304 can be utilized to establish a respective perimeter barrier 1206, 1306. One skilled in the art will recognize the various deployment configurations that multiple apparatus of FIGS. 1-6 can be arranged in depending on any desired need or application.

Figure 14:
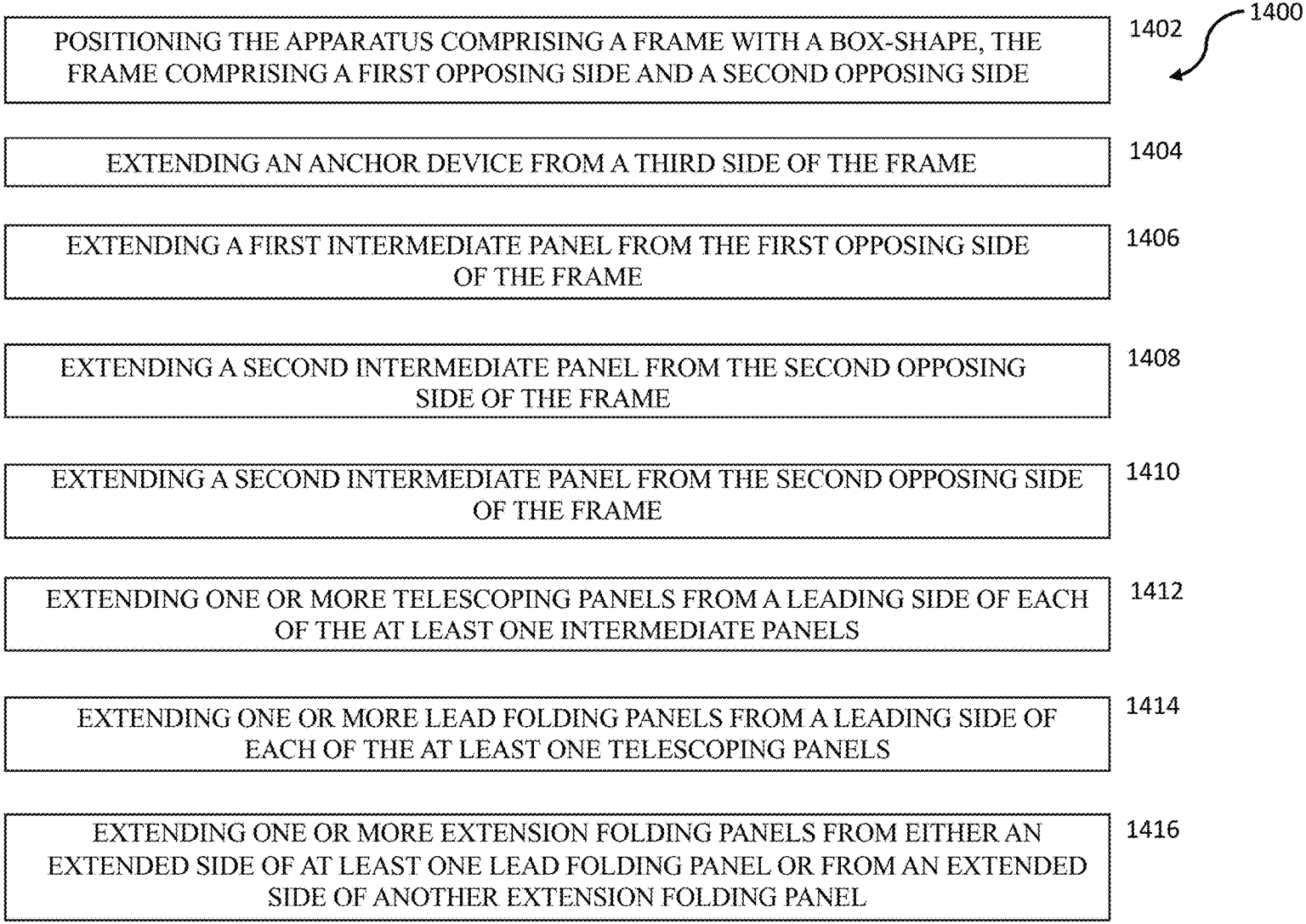
FIG. 14 illustrates a flowchart of an example process to install or deploy the example apparatus of FIGS. 1-6, according to an example embodiment of the disclosure.

FIG. 14 illustrates a flowchart of an example process to install or deploy the apparatus of FIGS. 1-6, according to an example embodiment of the disclosure. In the embodiment shown in FIG. 14, a method 1400 starts at block 1402. At block 1402, the method can include positioning the apparatus comprising a frame with a box-shape, the frame comprising a first opposing side and a second opposing side. Block 1402 is followed by block 1404, wherein the method can include extending an anchor device from a third side of the frame. Block 1404 is followed by block 1406, wherein the method can include extending a first intermediate panel from the first opposing side of the frame. Block 1406 is followed by block 1408, wherein the method can include extending a second intermediate panel from the second opposing side of the frame. Block 1408 is followed by block 1410, wherein the method can include extending one or more telescoping panels from a leading side of each of the at least one intermediate panels. Block 1410 is followed by block 1412, wherein the method can include extending one or more lead folding panels from a leading side of each of the at least one telescoping panels. Block 1412 is followed by block 1414, wherein the method can include extending one or more extension folding panels from either an extended side of at least one lead folding panel or from an extended side of another extension folding panel. One skilled in the art will recognize that the method can have a fewer or greater number of operations.

While the systems, methods, and apparatus have been described in connection with certain embodiments and specific examples, it is not intended that the scope be limited to the particular embodiments set forth, as the embodiments herein are intended in all respects to be illustrative rather than restrictive. Further, unless otherwise expressly stated, it is in no way intended that any method set forth herein be construed as requiring that its operations be performed in a specific order. Accordingly, where a method claim does not actually recite an order to be followed by its operations or it is not otherwise specifically stated in the claims or descriptions that the operations are to be limited to a specific order, it is in no way intended that an order be inferred, in any respect. This holds for any possible non-express basis for interpretation, including: matters of logic with respect to arrangement of operations or operational flow; plain meaning derived from grammatical organization or punctuation; the number or type of embodiments described in the specification.

It will be apparent to those skilled in the art that various modifications and variations can be made without departing from the scope of the disclosure. Other embodiments will be apparent to those skilled in the art from consideration of the specification and practice disclosed herein. It is intended that the specification and examples be considered as exemplary only, with the scope of the disclosure being indicated by the following claims.

That which is claimed is:

1. A deployable perimeter security apparatus comprising:

a frame with a box-shape, the frame comprising a first opposing side and a second opposing side;

an anchor device operable to extend from a third side of the frame;

a first intermediate panel operable to telescope from the first opposing side of the frame;

a second intermediate panel operable to telescope from the second opposing side of the frame;

one or more telescoping panels, each operable to telescope from a leading side of at least one intermediate panel;

one or more lead folding panels, each operable to mount to a leading side of at least one telescoping panel; and one or more extension folding panels, each operable to mount to either an extended side of at least one lead folding panel or an extended side of another extension folding panel.

2. The apparatus of claim 1, wherein the anchor device comprises one or more telescoping struts operable to extend from a retracted storage position to an extended deployed position, wherein, in the extended deployed position, the one or more telescoping struts facilitate supporting the frame in an upright position.

3. The apparatus of claim 1, wherein the anchor device comprises a square U-shape with a pair of telescoping struts operable to extend from a retracted storage position to an extended deployed position, wherein, in the extended deployed position, the pair of telescoping struts facilitates supporting the frame in an upright position.

4. The apparatus of claim 1, wherein the anchor device comprises one or more telescoping struts which, in a retracted storage position, facilitate positioning the one or more telescoping struts closely adjacent to the third side of the frame.

5. The apparatus of claim 1, wherein the first intermediate panel and second intermediate panel are operable to slide along one or more frame guides associated with an interior surface of the frame.

6. The apparatus of claim 1, wherein the one or more telescoping panels are operable to slide along one or more intermediate panel guides associated with a respective surface of the one or more intermediate panels.

7. The apparatus of claim 1, further comprising at least one hinge to facilitate folding each of the one or more lead folding panels to be closely adjacent to a respective extension folding panel.

8. The apparatus of claim 1, further comprising at least one hinge to facilitate folding each of the one or more extension folding panels to be closely adjacent to a respective extension folding panel.

9. The apparatus of claim 1, wherein a series of sharp devices are mounted on an upper lateral surface of each of the first intermediate panel, second intermediate panel, one or more telescoping panels, one or more lead folding panels, and one or more extension folding panels.

10. The apparatus of claim 1, wherein a fourth side of the frame, and at least one side of each of the first intermediate panel, second intermediate panel, one or more telescoping panels, one or more lead folding panels, and one or more extension folding panels comprise a ballistics resistant material.

11. A method for installing a deployable perimeter security apparatus, the method comprising:

positioning the apparatus comprising a frame with a box-shape, the frame comprising a first opposing side and a second opposing side;

extending an anchor device from a third side of the frame;

extending a first intermediate panel from the first opposing side of the frame;

extending a second intermediate panel from the second opposing side of the frame;

extending one or more telescoping panels from a leading side of each of the at least one intermediate panels;

extending one or more lead folding panels from a leading side of each of the at least one telescoping panels; and extending one or more extension folding panels from either an extended side of at least one lead folding panel or from an extended side of another extension folding panel.

12. A system comprising:

two or more deployable perimeter security apparatus, each apparatus comprising:

a frame with a box-shape, the frame comprising a first opposing side and a second opposing side;

an anchor device operable to extend from a third side of the frame;

a first intermediate panel operable to telescope from the first opposing side of the frame;

a second intermediate panel operable to telescope from the second opposing side of the frame;

one or more telescoping panels, each operable to telescope from a leading side of at least one intermediate panel;

one or more lead folding panels, each operable to mount to a leading side of at least one telescoping panel; and one or more extension folding panels, each operable to mount to either an extended side of at least one lead folding panel or to an extended side of another extension folding panel;

wherein a first deployable perimeter security apparatus is operable to connect to a second deployable perimeter security apparatus, when respective extension folding panels are fully extended, and the respective extension folding panels are closely adjacent to each other.

* * * * *